United States Patent [19]

Howerin

[11] Patent Number: 4,686,050

[45] Date of Patent: Aug. 11, 1987

[54] FABRIC RINSING LIQUID AND FABRIC TREATING METHOD

[76] Inventor: Charles Howerin, 817 NE. 29th Dr., Wilton Manors, Fla. 33334

[21] Appl. No.: 909,609

[22] Filed: Sep. 22, 1986

Related U.S. Application Data

[63] Continuation-in-part of Ser. No. 691,860, Jan. 16, 1985, abandoned.

[51] Int. Cl.[4] ..... D06M 11/15; B05D 3/02

[52] U.S. Cl. ..... 252/8.8; 427/393.4

[58] Field of Search ..... 8/137; 252/8.8

[56] References Cited

U.S. PATENT DOCUMENTS 3,827,857 8/1974 Boulus ..... 8/137

4,045,244 8/1977 Lange ..... 252/106

4,244,834 1/1981 Schwalley et al. ..... 252/106

4,292,035 9/1981 Battrell ..... 252/137

FOREIGN PATENT DOCUMENTS 1396195 6/1975 United Kingdom .

*Primary Examiner*—Prince E. Willis

*Assistant Examiner*—John F. McNally

*Attorney, Agent, or Firm*—Oltman and Flynn

[57] ABSTRACT

A rinsing liquid for use on fabric, preferably immediately after it has been cleaned with detergent. The rinsing liquid is preferably a mixture of disodium edetate and a cationic polymer made by quaternizing with methyl chloride the reaction product of dimethyl amine and epichlorohydrin.

2 Claims, No Drawings

FABRIC RINSING LIQUID AND FABRIC TREATING METHOD

RELATED APPLICATION

This application is a continuation-in-part of Ser. No. 06/691,860 filed Jan. 16, 1985, now abandoned.

SUMMARY OF THE INVENTION

This invention relates to a fabric rinsing liquid for use on carpet or upholstery fabric which has just been cleaned with a detergent, and to a method of treating such fabric by rinsing it with this liquid after cleaning it with a detergent.

One of the problems in using detergent to clean carpets, rugs or upholstery fabric is the difficulty of removing the detergent residue sufficiently. The detergent residue tends to make the fabric susceptible to soiling after it has been cleaned, possibly due to an undesirable wicking effect of the detergent residue on the fibers of the fabric.

In accordance with the present invention this problem is substantially overcome by a novel rinsing solution for use on the carpet or upholstery fabric, preferably immediately after it has been cleaned with detergent. The present rinse enhances the removal of the detergent residue, neutralizes the alkalinity of the detergent residue, and acts as a dye fastener on the fabric.

A principal object of this invention is to provide a novel aqueous rinsing solution to be applied to carpet or upholstery fabric which has just been cleaned with a typically alkaline detergent.

Another object of this invention is to provide a novel method of treating carpet or upholstery fabric by rinsing it with this solution after cleaning it with detergent.

Further objects and advantages of this invention will be apparent from the following detailed description of a presently preferred embodiment.

DETAILED DESCRIPTION

One ingredient of the present rinse is a disodium salt known as disodium edetate or as the tetraacetic acid, ethyleneinitrila, having the formula

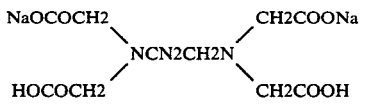

This disodium salt is sold under the name "EDTA" as weakly acidic dihydrate crystals.

The second ingredient of the present rinse is a complex polymer made by reacting dimethyl amine and epichlorohydrin, forming a polymer with the backbone

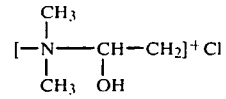

This reaction product is then quaternized with methyl chloride. It is a light amber liquid, water soluble and cationic, with a pH of from 3.0 to 6.0, a viscosity of 500 to 1,000 cps, and a specific gravity of 1.06–1.13. It is an effective antistatic agent. It is available commercially from Burlington Chemical Co., Inc. of Burlington, N.C. under the trademark BURCOLOC.

The third ingredient of the present rinse is water.

Preferably, the rinsing solution has the following proportions by weight:

about $3.76\times10^{-4}$% to about 3.7% of the above-specified disodium salt about 2.5% to about 10% of the above-specified cationic polymer and balance water.

It may be prepared by mixing the disodium salt with a half-batch of water, mixing the cationic polymer with another half-batch of water and then mixing the two half-batch mixtures.

This rinsing solution is applied after the carpet or upholstery fabric has been cleaned the usual way with a conventional detergent, which is somewhat alkaline. The acidity of the rinsing solution neutralizes the alkalinity of the detergent residue in the fabric. In addition, the rinsing solution is very effective in removing virtually all of the detergent residue from the fabric. Finally, the cationic polymer ingredient of the rinsing solution acts as a dye fastener which prevents color or dye migration, or "bleeding".

A solution comprising about 3.7% of the disodium salt and about 2.5% of the cationic polymer with the balance water has been found to be effective. Also, a solution comprising about $3.76\times10^{-4}$% of the disodium salt and about 10% of the cationic polymer, the balance water has been found to be effective, even though the disodium salt content is low. Both ingredients must be present to get the desired results.

I claim:

1. A fabric rinsing liquid in the form of an aqueous mixture of disodium edetate and a liquid cationic polymer made by quaternizing with methyl chloride the reaction product of dimethyl amine and epichlorohydrin, said mixture containing substantially $3.76\times10^{-4}$% to 3.7% disodium edetate and 2.5% to 10% of said cationic polymer, by weight, and the balance water.

2. A method of treating carpet or upholstery fabric which comprises:

cleaning the fabric with an alkaline detergent;

and thereafter rinsing the fabric with an aqueous mixture containing about $3.76\times10^{-4}$% to 3.7% by weight of disodium edetate and about 2.5% to 10% by weight of a reaction product of dimethyl amine and epichlorohydrin quaternized with methyl chloride.

* * * * *